United States Patent [19]

Beekman

[11] Patent Number: 4,670,997

[45] Date of Patent: Jun. 9, 1987

[54] ATHLETIC SHOE SOLE

[76] Inventor: Stanley Beekman, 13601 St. James Ave., Cleveland, Ohio 44135

[21] Appl. No.: 592,937

[22] Filed: Mar. 23, 1984

[51] Int. Cl.[4] ..... A43B 13/04; A43B 13/22

[52] U.S. Cl. ..... 36/114; 36/32 R; 36/59 C; D2/320

[58] Field of Search ..... 36/59 R, 59 A, 59 B, 36/59 C, 25, 32 R, 31, 8.1, 113, 128, 7.7, 7.6, 114, 126, 128; D2/320, 312, 311

[56] References Cited

U.S. PATENT DOCUMENTS

| | | | |
|---|---|---|---|
| D. 259,595 | 6/1981 | Famozare, Jr. | D2/320 |
| 1,049,087 | 12/1912 | Hill | 36/59 C |
| 1,440,060 | 12/1922 | Conger | 36/59 C |
| 1,552,022 | 9/1925 | Willson | 36/59 C |
| 2,229,406 | 1/1941 | Cutler | 36/59 C |
| 2,677,905 | 5/1954 | Dye | 36/128 |
| 2,985,971 | 5/1961 | Murawski | 36/32 R |
| 4,120,102 | 10/1978 | Kenigson | 36/59 C |
| 4,266,349 | 5/1981 | Schmohl | 36/59 C |
| 4,375,728 | 3/1983 | Dassler | 36/114 |
| 4,402,145 | 9/1983 | Dassler | 36/32 R |

*Primary Examiner*—Werner H. Schroeder
*Assistant Examiner*—Steven N. Myers
*Attorney, Agent, or Firm*—D. Peter Hochberg

[57] ABSTRACT

A shoe having a sole for facilitating rotation about an axis of rotation normal to the sole in response to the application of a moment about the axis of rotation. The sole contains flexible engagement means which comprises: flexible members radially spaced from the axis of rotation and guide means for impeding the flexing of the flexible members in response to forces which do not create moments about the axis of rotation, while allowing flexing of the flexible members in response to forces which do create moments about the axis of rotation.

6 Claims, 30 Drawing Figures

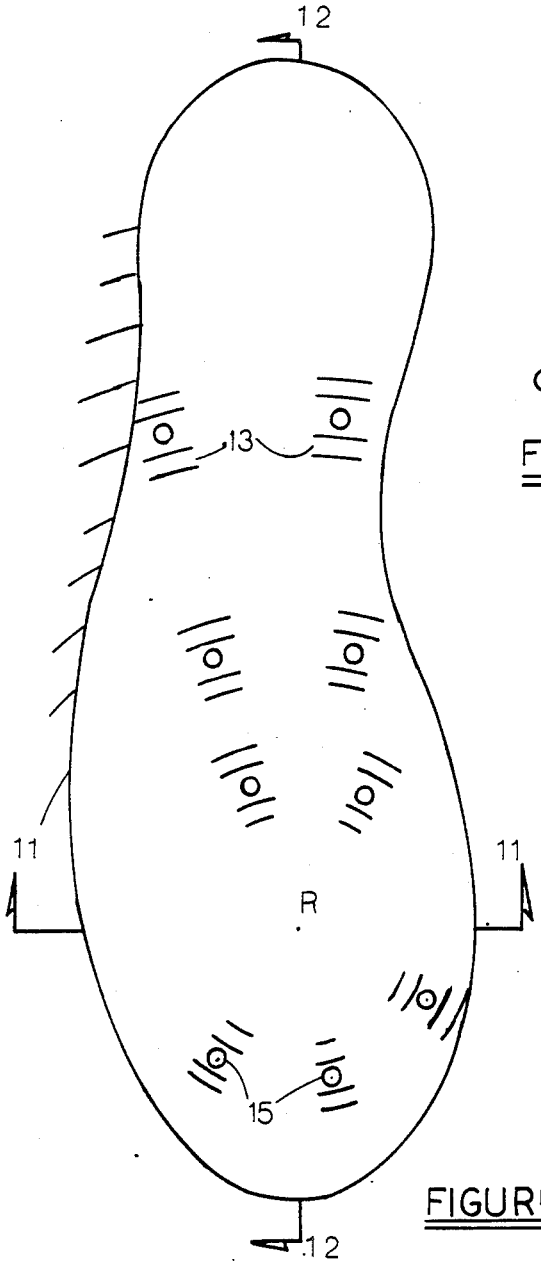
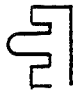
FIGURE 12
FIGURE 10
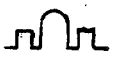
FIGURE 11

PRIOR APT

ATHLETIC SHOE SOLE

BACKGROUND OF THE INVENTION

The invention relates to soles for athletic shoes and to athletic shoes, and in particular to such soles and shoes used in activities involving rotation on one or both feet. These activities include court sports such as basketball and squash, and field sports such as American football, soccer and baseball.

Athletic shoes have long been known which include means for improving traction with the ground. Shoes with treads of various configurations have been used widely, especially in sports where running is involved. The soles of shoes for court sports have been provided with a variety of trend designs for enhancing traction to enable fast starting, stopping and turning. In sports such as baseball, football, soccer and the like which are played on turf, athletic shoes are conventionally provided with cleats or spikes for digging into the earth to provide the desired traction and to facilitate the rapid changing of direction.

Although known tread designs and cleats greatly improve traction, they have been the source of foot and knee injuries to many athletes. Known tread designs improve traction in all directions, and tend to hold the foot fast even when the wearer is jolted or loses his or her balance, causing forces to be absorbed by the persons's tendons, ligaments and muscles. Rigid cleats as presently known are responsible for more joint injuries in the foot and knee in football, soccer and baseball than any other cause. These injuries have been found to occur because the foot is temporarily fixed to the ground by virtue of the engagement of the cleats with the ground, and the leg is unable to absorb the shock of forces imparted to it by removal of the threatened joint from the force or by corrective anatomical realignment before injury occurs. Moreover, the knee is most often in a fixed or locked state with the ligaments and muscles of the leg holding its component parts in a generally semi-flexed condition. When the athlete makes a sudden turn or "cut", or when as in football the athlete is blocking or being blocked or being tackled or when a baseball player "rounds" a base, or a pitcher pivots as he delivers a pitch, the forces impressed on the knee and ankle joints of the leg often distort the joint axes and tear or strain ligaments—these injuries most frequently being the direct result of the fixation of the foot relative to the ground.

The problem of omnidirectional traction in treaded shoe soles as a cause of foot and leg injury has apparently neither been recognized nor addressed. Various proposals have been made for releasing a football player's cleated foot from the fixed condition when potentially dangerous forces or torques are imparted to the leg or foot. Thus, a swivel shoe has been proposed for use in football which includes a turntable rotatably mounted on the forefoot part of the shoe, the turntable carrying cleats for gripping the turf. The turntable rotates in response to the exertion of a predetermined minimum torque about its axis of rotation for the purpose of eliminating rigid cleating under deleterious force conditions. A second turntable having a beveled notch mounted for rotation on the heel of the shoe is provided for adding further mobility to the foot. The foregoing swivel shoe and a discussion of the mechanics of the foot giving rise to the injuries discussed herein can be found in "The Swivel Football Shoe: A Controlled Study" by Bruce M. Cameron, M.D. and Otho Davis in *The Journal of Sports Medicine,* January/February 1973, p. 16. Another swivel football shoe is disclosed in U.S. Pat. No. 3,707,047 issued Dec. 26, 1972 to Nedwick. Such shoes have not found acceptance among football players, probably because of the inherent problems of malfunctioning and unreliability associated with the movable mechanical elements incorporated in these shoes. Another football shoe intended to avoid the foregoing disadvantages but also not used for probably the same reasons noted with regard to swivel football shoes, is a football shoe disclosed in U.S. Pat. No. 3,668,792 issued June 13, 1972 to York, having a breakaway sole which is removed from the body of the shoe when predetermined transverse force is applied. Significantly, no such cleated shoes have been proposed for other sports such as baseball, where similar danger of leg injuries exist.

SUMMARY OF THE INVENTION

An object of the present invention is to provide athletic shoe soles, spikes or cleats for athletic shoes, and athletic shoes incorporating these devices, for avoiding injuries to a person's ankle or knee joints upon the application of potentially damaging forces or torques to the foot.

Another object of this invention is to provide an athletic shoe sole and shoe construction for facilitating rotational movement of the foot relative to the ground.

A further object is the provision of an improved athletic shoe and spike or cleat therefore for releasing the foot from fixation with the ground in response to the application of potentially dangerous forces or torques to the foot, which is simple and economic to construct, and effective in use.

Another object of the invention is to provide an athletic shoe and spike or cleat therefore of the foregoing type which has no moving parts.

Other objects will be apparent to those skilled in the art from the description to follow and from the appended claims.

These objects are achieved according to preferred embodiments of the invention by a shoe sole construction wherein engagement means are provided for bending relatively easily in response to rotational forces about a predetermined center of rotation, to provide limited rotation of the foot relative to ground and thereby relieve the foot and leg of stress and strain they would otherwise endure. According to other preferred embodiments of the invention, a curvilinear cleat or spike on the sole of an athletic shoe is provided wherein the cleat or spike has an axis of rotation disposed in the area of the second metatarsal head of the wearer's foot, the foot and shoe rotating about such axis upon the application of forces or torques to the foot which might cause injury to the wearer's leg were his foot fixed in the ground.

BRIEF DESCRIPTION OF THE DRAWINGS

FIG. 10 is a bottom plan view of a sole and shoe pursuant to another embodiment of the invention, and FIGS. 11 and 12 are sectional views taken in the directions 11—11 and 12—12, respectively.

FIG. 22 is a bottom plan view of an athletic shoe according to the invention used for playing baseball.

FIG. 29 is a bottom plan view of another embodiment of the invention, and

FIG. 30 is a view taken in the direction 30—30.

DETAILED DESCRIPTION OF THE PREFERRED EMBODIMENT

Figures 1, 2, 3:
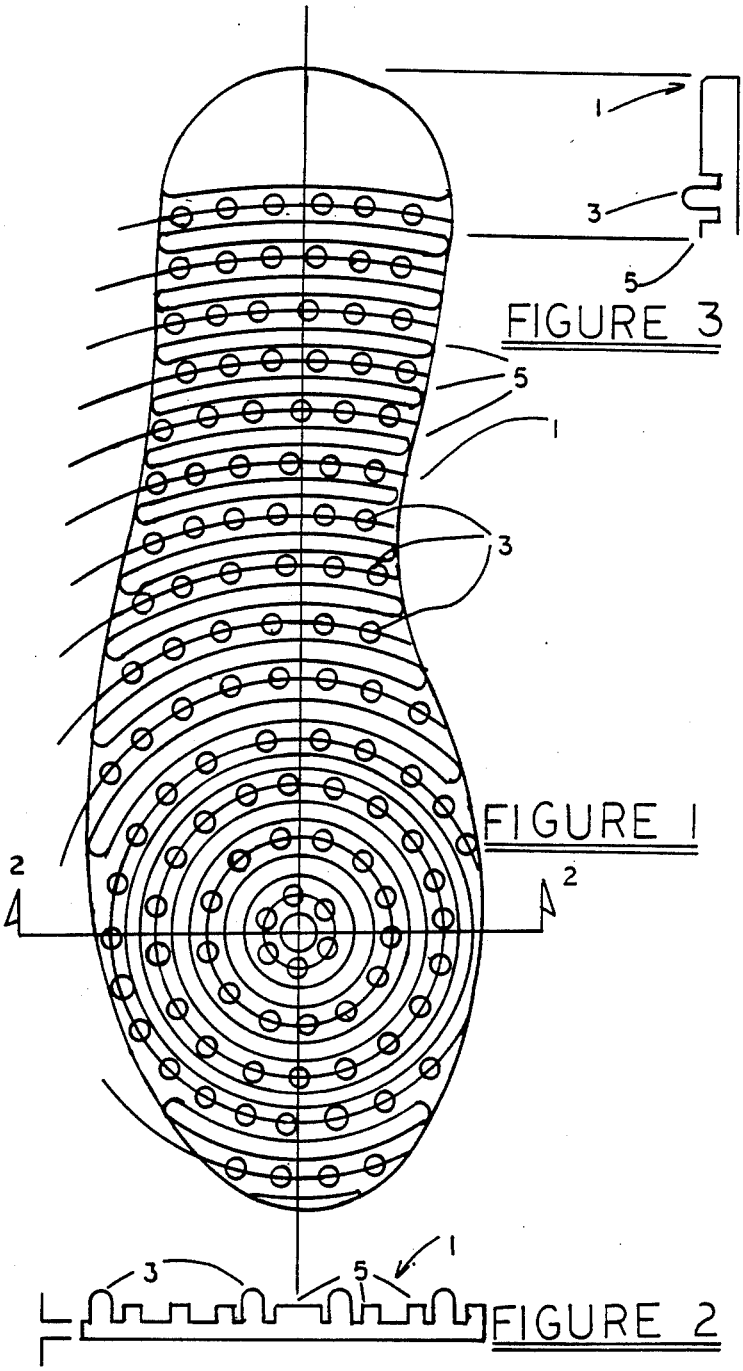
FIG. 1 is a bottom plan view of a shoe sole and shoe according to an embodiment of the invention.
FIGS. 2 and 3 are sectional views of the sole taken in the direction 2—2 and 3—3, respectively.

Referring first to FIGS. 1–3, an athletic shoe sole 1 is shown which, like other embodiments discussed below, tends to rotate about a predetermined axis of rotation upon the application of forces resulting in moments about that axis. Accordingly, the sole is provided with engagement means comprising sets alternating rows of flexible studs 3 and relatively rigid walls 5 arranged generally concentrically about an axis of rotation R, which is located near the position of a wearer's second metatarsal head when the shoe is on a foot. Studs 3 protrude below the lowermost surface of walls 5, so that they flex when the wearer puts his or her weight on the shoe. In a preferred construction, studs 3 are ⅜ inch high and walls 5 are 3/16 inch high. The surfaces of studs 3 and walls 5 contacting the ground create friction in the well-known manner. However, when moments are applied about axis R from applied forces having components perpendicular to radii extending from axis R, the resistance to rotational movement about axis R is relatively low compared to the resistance in other horizontal directions, and the shoe tends to rotate about axis R. This tendency to rotate can avoid injury to the wearer, since those injuries occurring when forces and moments applied to the wearer whose foot is fixed in place—as discussed previously—do not occur. Rather, the foot will rotate and expend the energy in the process which would otherwise have been applied to the wearer's body tissues had the foot been fixed.

The alternating concentric rings of walls and studs effect the foregoing rotational movement. Walls 5 serve as guides for studs 3. Force components on studs 3 in the radial direction relative to axis R tend to drive the studs against the walls, thus effecting high resistance against movement in the radial direction. Such high resistance makes for fast starting and stopping—a desirable feature for many athletic activities. However, when moments are applied about axis R, walls 5 do not resist the bending of studs 3 and the studs tend to flex. The shoe and foot therefore turn easily about axis R until the studs are bent so that their lowermost surfaces are flush with the bottom or lowermost surfaces of walls 5. This easy rotation provides the safety feature referred to above.

Another construction for achieving the rotational movement discussed above is shown in FIGS. 4–6. Engagement means comprising sets of radially extending studs or flanges 7 extend in the direction from axis R, their radial lengths being defined by concentric circles about axis R. In their preferred form, the side drafts of the studs are 6°, and they extend ½ inch in the radial direction. Flanges 7 are preferably ⅛ inch thick at their bases, ⅜ inch high, and separated from each other by 1/16 inch at their bases. Flanges 7 remain relatively rigid when radially directed forces are applied, but they tend to bend easily in response to moments applied about axis R. Therefore, the shoe rotates in response to the latter moments until the flanges 7 are bent to their full extent.

Figures 7, 8, 9:
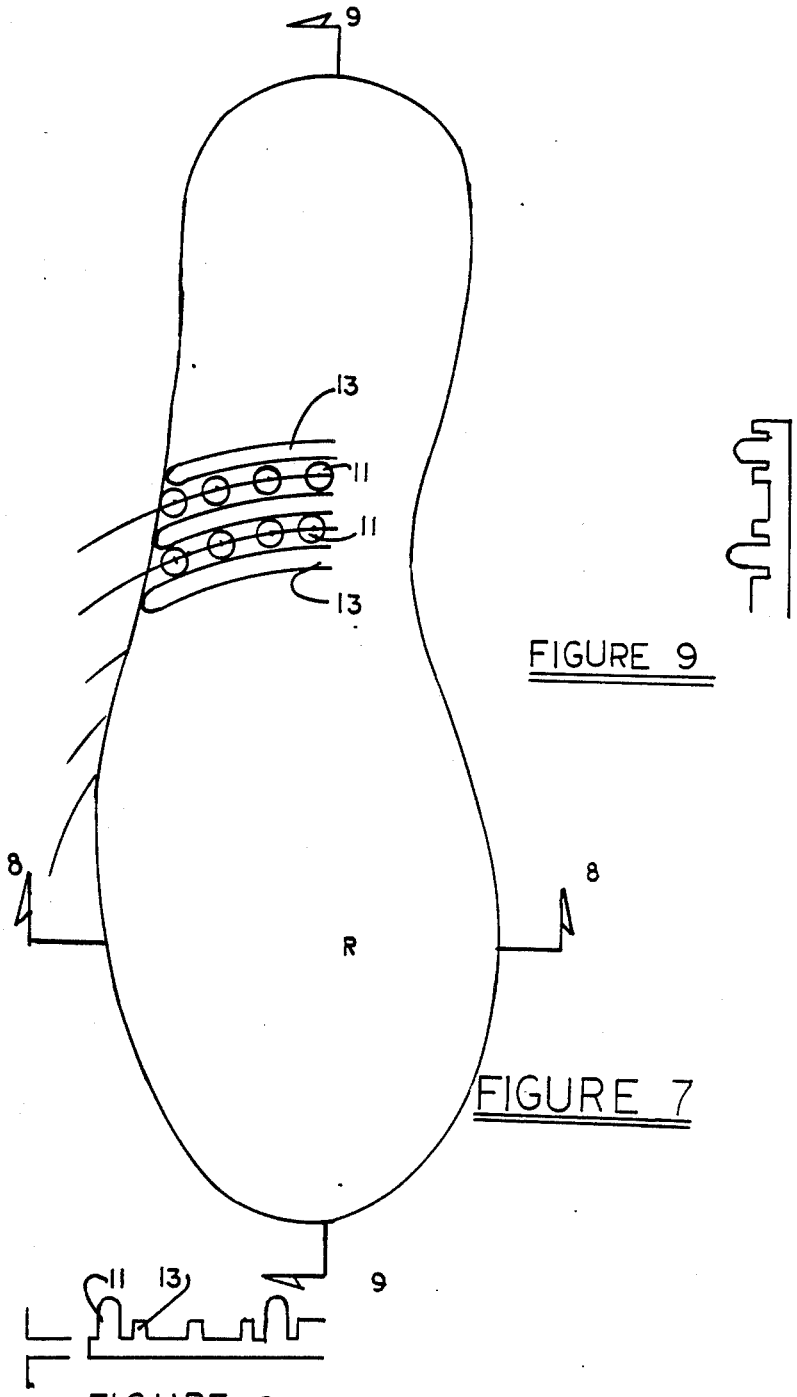
FIG. 7 is a bottom plan view of another embodiment of the invention.
FIGS. 8 and 9 are sectional views taken in the directions 8—8 and 9—9, respectively.

The rotational effect can be achieved by covering the entire bottom of the sole with a tread construction as described previously. As shown in FIGS. 7–9, only a portion of the sole can have such construction. In the latter case, a sole is again provided which tends to rotate about a rotational axis R near the wearer's second metatarsal head upon the application of forces transverse to radii of that axis. Here, only a few (e.g., eight) studs 11 are provided which extend below respective pairs of arcuate guide walls 13. As before, studs 11 are held generally upright upon the application of radial force components, but they bend easily when the force components are transverse to such radii.

The sets of bending elements and guide means for effecting the foregoing rotational movement need not be adjacent one another. As shown in FIGS. 10–12, a plurality of sets of guide walls 13 for restricting the bending of a plurality of studs 15 in the radial direction relative to axis of rotation R, but enabling such bending about axis R as discussed earlier, can be positioned at spaced locations on the sole of the shoe. As discussed previously, in their unstressed state, studs 15 extend below the bottoms of walls 13.

Figure 13:
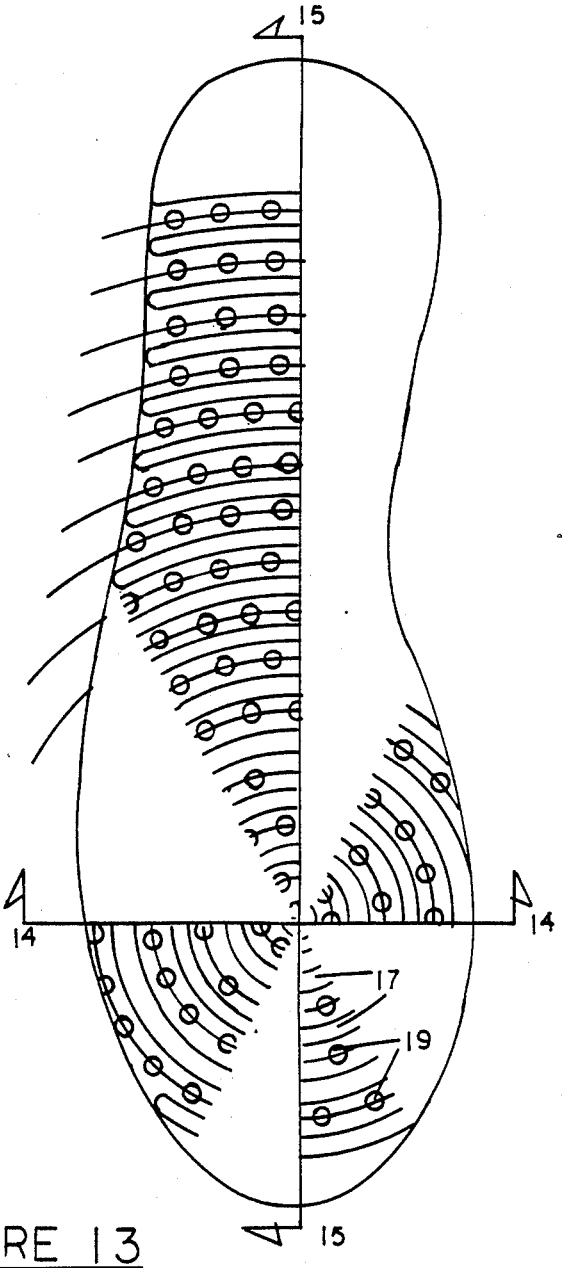
FIG. 13 is a bottom plan view of a sole and athletic shoe according to another embodiment of the invention.
Figure 15:
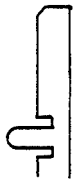
FIGS. 14 and 15 are sectional views taken in the directions 14—14 and 15—15, respectively.
Figure 14:
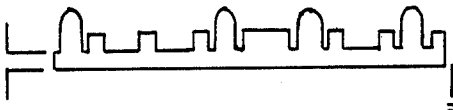

The embodiment shown in FIGS. 13–15 shows how the number of bending elements and guide means can be reduced to reduce the weight of the shoe. The guide walls 17 and studs 19 of FIGS. 13–15 are similar in construction to those of FIG. 1, but their reduced number lessens the weight of the shoe and could simplify their manufacture by simplifying sole producing molds.

Figures 4, 5, 6:
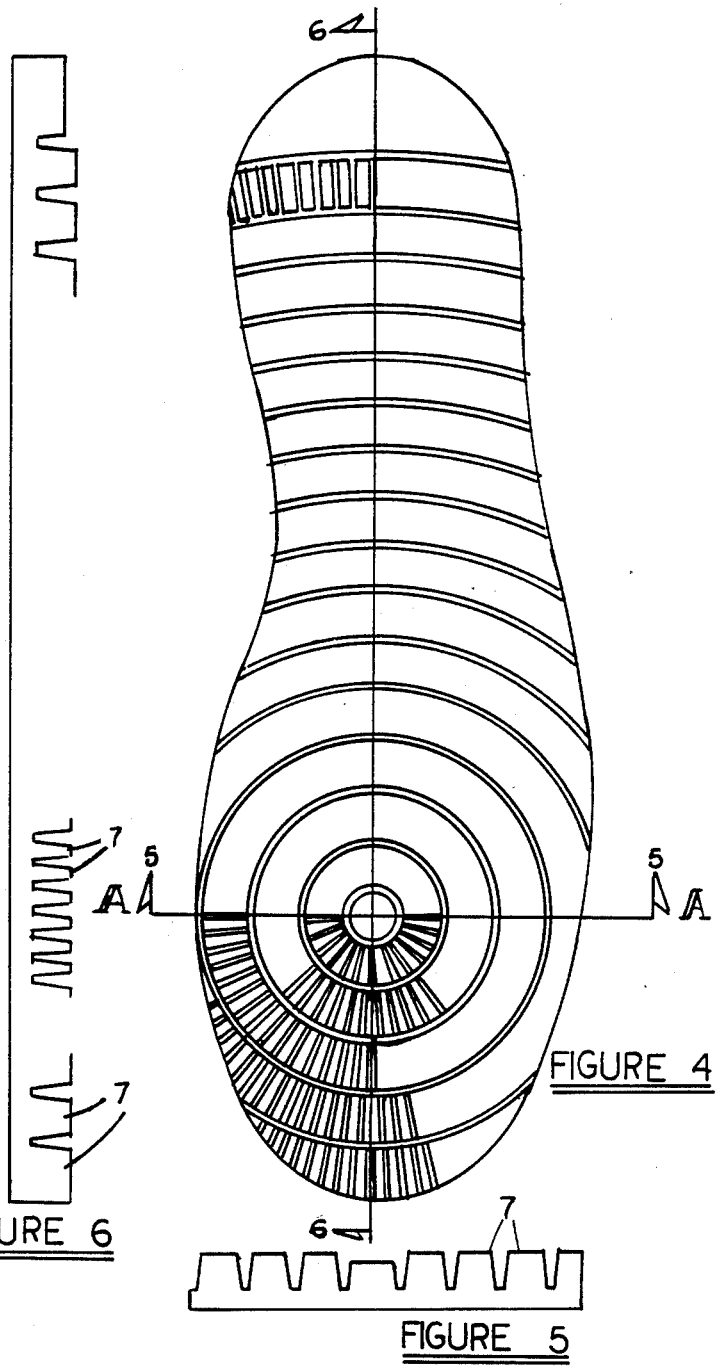
FIG. 4 is a bottom plan view of a shoe sole and shoe according to another embodiment of the invention.
FIGS. 5 and 6 are sectional views of the sole taken in the directions 5—5 and 6—6, respectively.
Figure 17:
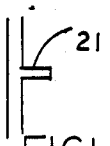
FIG. 17 is a sectional view taken in the direction 17—17.
Figure 16:
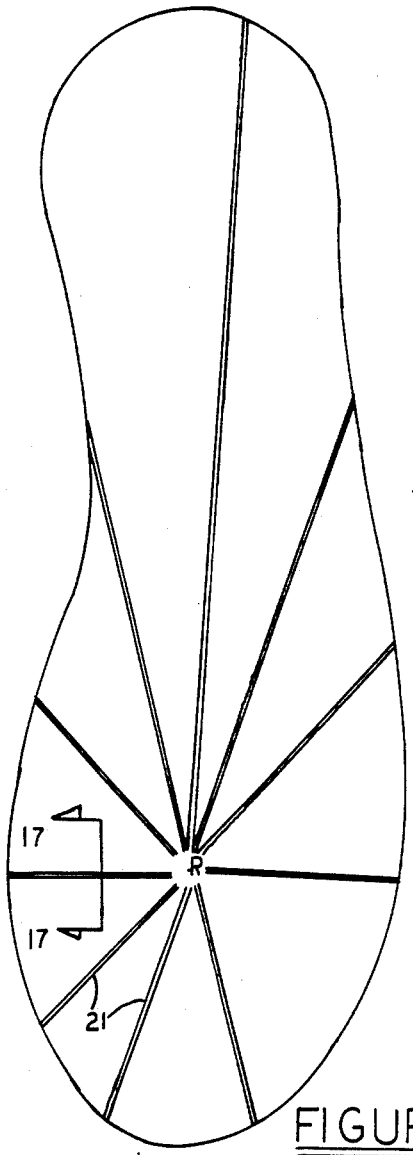
FIG. 16 is a bottom plan view of a sole and shoe according to a further embodiment of the invention.

While aside from the embodiment of FIGS. 4–6, the preceding embodiments incorporate cooperating guide means and bending elements for achieving the desired rotational effect, a single set of elements can be used. Thus, referring to FIGS. 16 and 17, a shoe sole is shown having a set of flexible flanges or walls 21 extending radially from axis of rotation R, again located near the location of the wearer's second metatarsal head. Walls 21 flex relatively easily in response to transverse forces to radii from axis R, enabling the limited rotation of the shoe about axis R in response to such forces, while remaining relatively rigid in response to forces directed towards axis R.

Figure 19:
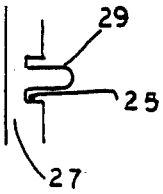
FIG. 19 is a section taken in the direction 19—19.
Figure 20:
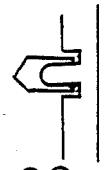
FIG. 20 is a modification of this embodiment.
Figure 18:
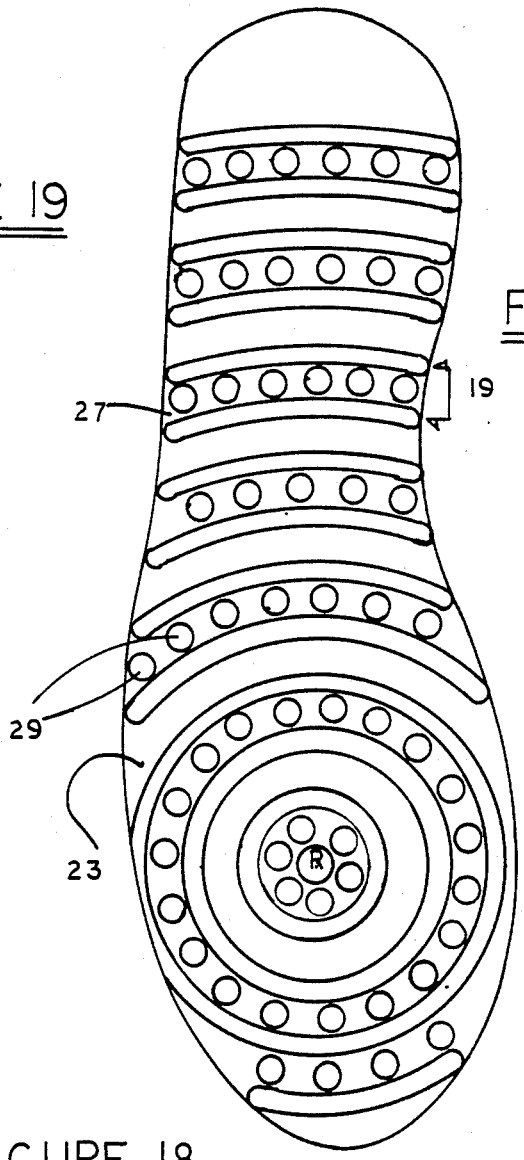
FIG. 18 is a bottom plan view of a sole and shoe according to still a further embodiment of the invention.

The soles of various embodiments of the invention discussed above can be made as a unitary structure by known molding techniques. An embodiment similar to that of FIG. 1 is shown in FIGS. 18–20, which is multipart construction and is particularly suited for such hardwood (or the like) court sports as basketball, racquetball and squash. In this embodiment, the outersole has a bottom layer 23 with a plurality of annular openings 25 about an axis of rotation R. An inner layer 27 is disposed above layer 23 and includes a number of sets of flexible studs 29 positioned to extend through openings 25 as shown. The operation of the embodiment is similar to that of FIGS. 1–3. When the latter construction is to be used on artificial turf, hard tips 31 which can be made of steel or the like should be attached to the studs as shown in FIG. 20, to facilitate the desired ground contact.

The foregoing means for achieving the desired rotation in the sole of a shoe can be disposed above the sole, i.e., between the outersole and the midsole of the shoe. Since it is the rotation of the foot which is desired when potentially dangerous forces occur, the rotation can occur in the midsole relative to the outersole. Thus, the flexible elements can extend upwardly from the outersole towards the midsole, or vice versa, with the guide means similarly disposed. It is further possible to render rotation easier in one direction than in the opposite direction. This can be accomplished by providing guide means adjacent one side of the flexing elements and extending radially from the axis of rotation.

Figure 21:
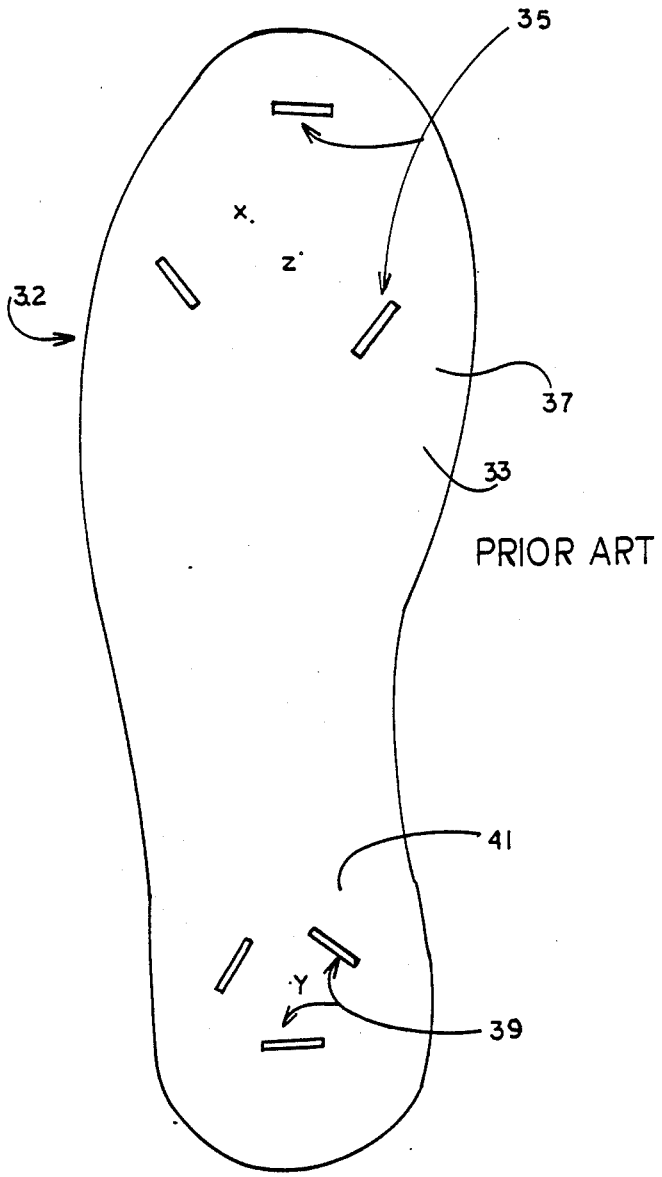
FIG. 21 is a bottom plan view of a prior art athletic shoe used for playing baseball.

Referring next to FIG. 21, a conventional baseball shoe 32 is shown. The shoe includes a sole 33 on which are mounted a set of cleats or spikes 35 extending from the toe or forward portion 37, and a set 39 extending from the rearward portion 41 of the shoe, for digging into the earth to improve the traction of the player wearing the shoe. The cleats are typically made of a hard, strong metal such as aluminum or steel, or plastic such as polyurethane, and have a thin body extending from the shoe and terminating in a sharp edge for piercing the earth. Cleats 35 and 39 are often part of a unitary element bearing all of the cleats of each set, each such element being attached to the sole by appropriate fastening means such as tacks or rivets. A significant characteristic of known shoes 31 is the placement of cleats 35 and 39, which are disposed generally about axes of rotation x and y, respectively, which are generally perpendicular to the plane of sole 33. Although cleats 35 and 39 are effective in improving traction, they inhibit the natural rotation of the foot about an axis z in the area of the second metatarsal head of the wearer's foot. Both the spacing of axes x and y from axis z, and the existence of two such axes of the sole and rear cleats 35 and 39, actually causes the cleats 35 and 39 to brake the natural rotation of the foot. Therefore, when the wearer attempts to pivot about his foot, the cleats oppose the rotation about axis z; and if the foot cannot rotate adequately, the bones of the knee and/or ankle may absorb the rotational forces causing potentially dangerous stresses on the ligaments and tendons in the leg and on the bones themselves. A corresponding effect occurs to the wearers of other cleated athletic shoes such as football cleats, where the natural rotation of the foot is impeded by the location of the cleats.

The configuration of the cleats themselves also contribute to the resistance against rotation about the natural axis of rotation z of the foot. Thus, conventional football and soccer cleats are of cylindrical or truncated conical shape for the purpose of improving traction; however, such cleats block rotation of the wearer's foot about the second metatarsal head.

Athletic shoes and cleats according to a preferred embodiment of the present invention reduce the risk of leg injuries when rotational forces are exerted on the wearer's foot, without effecting the traction of the shoe. This is accomplished by orienting and constructing the cleats to enable rotation of the wearer's foot about an axis in the area of the second metatarsal head upon the application of rotational forces and torques to the foot.

Turning to FIG. 22, an athletic shoe 43 according to the invention is shown. Shoe 43 has a sole 45 with a toe or forward portion 47, and a heel or rearward portion 49. A plurality of cleats are generally radially disposed about axis z passing through sole 45 in the area of the second metatarsal head of the wearer's foot. Thus, a first set of cleats 51 is located close to axis z, a second set of cleats 53 is located concentrically about axis z and cleats 51, and a final set of cleats 55, 56 concentric with axis z and more distant from axis z is disposed on the heel portion 49 of the sole.

Although each set is shown as corresponding to segments of circles about axis z, one or more sets could comprise a single cleat spaced a particular radial distance from axis z. Furthermore, although the cleats shown are curved to facilitate rotation about axis z, they could be straight and appropriate segments of curved cleats.

The arrangement of cleats concentric about an axis passing through the area of the second metatarsal head of the wearer's foot provides the desired traction in all directions of travel, while enabling rotation of the foot about its natural axis of rotation to reduce the likelihood of leg damage which might otherwise occur from foot fixation. Also, the location of a cleat in the arch area provides a stiffening and strengthening support in that area of the shoe.

To further enhance the rotatability of the foot about axis z, the ends of the cleats can be tapered at their ends rather than being perpendicular to the sole as in conventional cleats, to facilitate the rotation of the shoe about axis z.

Figure 24:
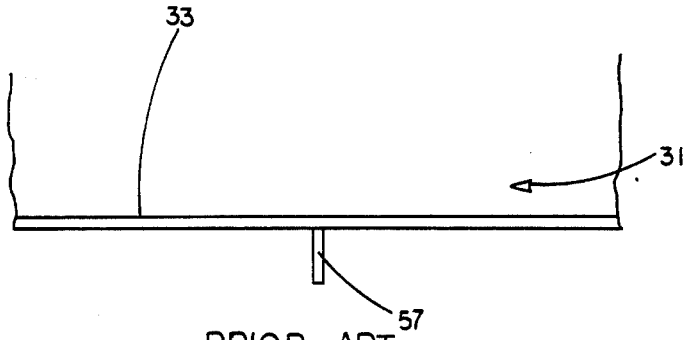
PRIOR ART FIGURE 24
FIGS. 23–25 are detailed side, end and plan views, respectively, of a prior art baseball cleat.
Figure 23:
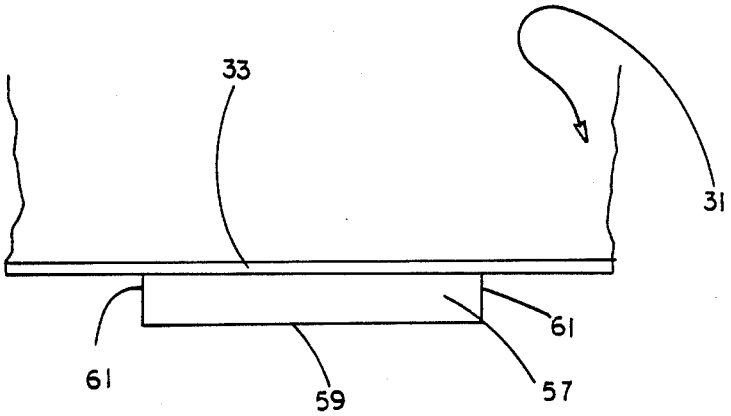
Figure 25:
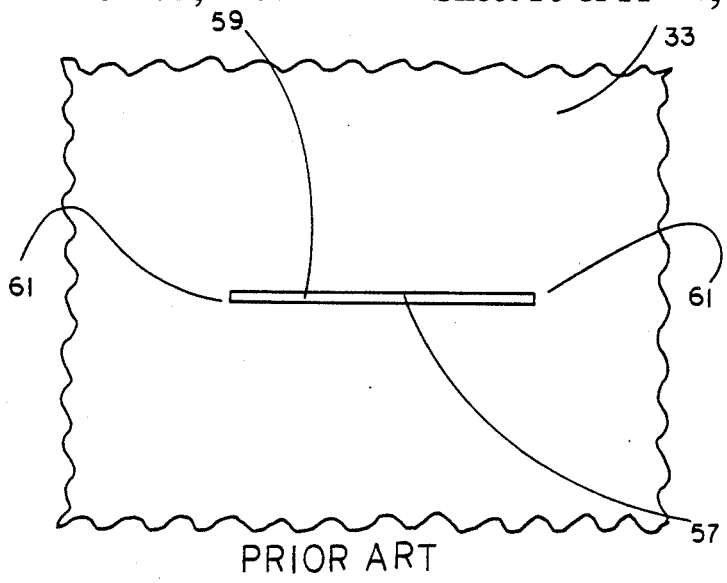
Figure 26:
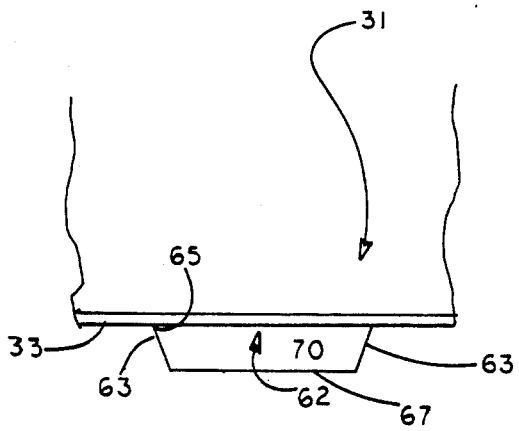
FIGS. 26–28 are detailed side, end and plan views, respectively, of baseball cleats according to the invention.
Figure 27:
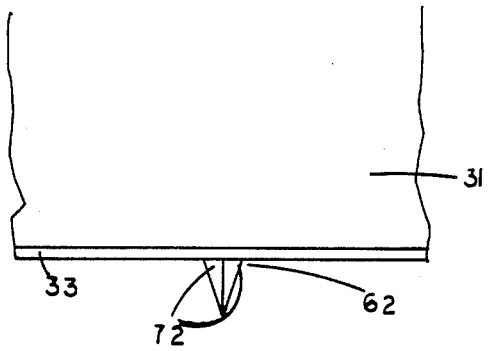
Figure 28:
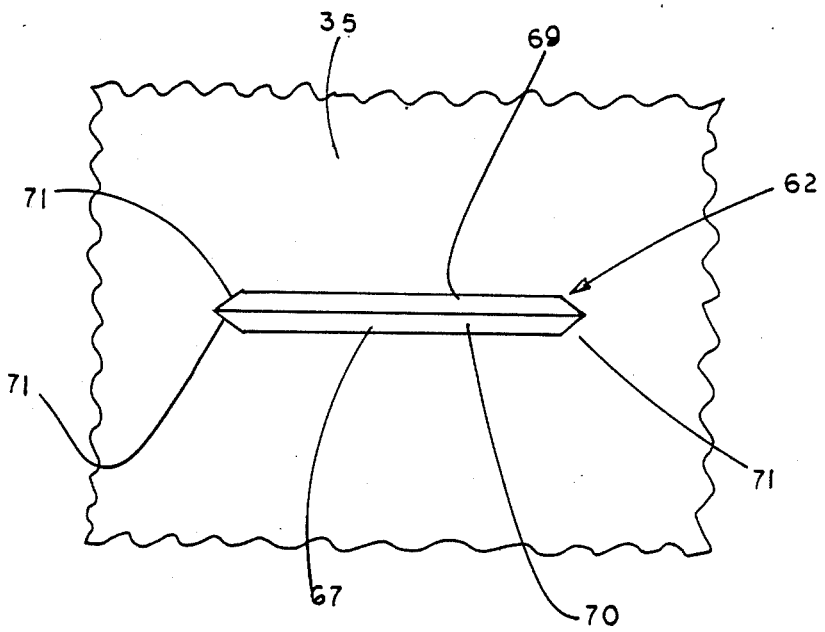

FIGS. 23–25 show a prior art cleat 57 extending from the sole 33 of a baseball shoe. Cleat 57 has a generally prismatic configuration, with a flat ground engaging edge 59 and blunt ends 61. Since edge 59 is relatively thin, cleat 57 can easily pierce the turf. However, conventional cleats 57 are inhibited from slicing through the turf during pivoting of the foot—especially about the second metatarsal head—primarily because of the prismatic configuration. A preferred cleat configuration according to the invention is shown in FIGS. 26–28. Cleats 62 are accordingly shown attached to and extending from the sole 33 of shoe 31. The cleats are shown as being cruved, about the natural axis of rotation of the wearer's foot, vis. axis z (see FIGS. 24 and 25). The opposite ends 63 of cleat 62 are tapered inwardly from their juncture 65 with the sole (or from a place near the sole) towards the ground piercing edge 67 of the cleat. Furthermore, opposite sides 69, 70 of cleat 62 are tapered from the region nearest the sole to make edge 67 a sharpened shape. Ends 63 are preferably tapered towards each other as shown at 71 to further facilitate the ability of cleat 62 to cut through the turf when potentially dangerous rotational forces are imparted to the wearer's foot.

In some cases it is desirable to facilitate propulsion of shoes and cleats according to the invention in a particular direction, and this can be accomplished by the configuration of the cleats. For example, the foot of a pitcher on the same side of his body as his pitching arm is "propulsive", in that the pitcher uses that foot to drive his body forward during the pitching motion. Likewise, a baseball batter's foot is propulsive on the same side of his body as he bats from. Accordingly, a right-handed pitcher's or batter's propulsive foot is his right foot. In order to enhance the propulsive effect, the taper of the sides of the cleats corresponding to sides 69 and 70 in FIG. 24 can comprise a taper only on the side of the cleat in the direction of the intended propulsion. That is, the side of the cleat facing the direction of intended propulsion is tapered more than the other side. FIGS. 29–30 show a straight cleat 73 (not curved as shown in FIG. 24) for the right foot of a right-handed pitcher. The cleat is tapered on a side 75 from the sole 33 towards a ground piercing edge 77, while a side 79 opposite side 75 is perpendicular to sole 33 and thus provides greater traction when the pitcher moves his body in the direction of propulsion (towards home plate). This configuration does not significantly affect the ability of the cleat to rotate about the second metatarsal head of the wearer's foot.

The latter embodiments of the invention have been described in their preferred form with regard to baseball athletic shoes. The invention finds application to spiked or cleated shoes for any sport, with adaptations according to the construction and function of the cleat and to the type of forces to be applied to the wearer's foot.

The invention has been described in detail with particular reference to the preferred embodiments but it should be understood that variations and modifications within the spirit and scope of the invention may occur to those skilled in the art to which the invention pertains.

I claim:

1. A shoe sole for facilitating rotation about an axis of rotation normal to said sole in response to the application of a moment about said axis, said sole comprising:

a support layer; and at least one flexible engagement means extending from said support layer, said engagement means comprising:

a plurality of flexible members radially spaced from said axis and extending from said layer; and guide means for impeding the flexing of said flexible members in response to the application of forces which do not create moments about said axis and for enabling the flexing of said flexible members in response to the application of moments about said axis.

2. The invention according to claim 1 wherein said flexible members comprise studs, and said guide means comprise walls radially spaced relative to said axis on opposite sides of said studs.

3. The invention of claim 1 wherein said flexible members and said guide means are disposed substantially over a surface of said sole.

4. The invention of claim 1 wherein said flexible members and said guide means are disposed at spaced locations on a surface of said sole.

5. The invention of claim 1 wherein said sole comprises an inner sole and an outer sole, said flexible members are disposed on said inner sole, and said outer sole having openings aligned with said flexible members through which said flexible members protrude.

6. A shoe sole for facilitating rotation about an axis of rotation normal to said sole in response to the application of a moment about said axis, said sole comprising:

a support layer; and flexible engagement means extending from said support layer, said engagement means comprising a plurality of sets of flanges spaced radially from each other and having a radial length greater than the width taken perpendicularly to said length.

* * * * *